United States Patent [19]

Feron et al.

[11] Patent Number: 4,844,631

[45] Date of Patent: Jul. 4, 1989

[54] THERMAL PRINT HEAD PRINTER INCLUDING A PLATEN

[75] Inventors: Jean-Marc Feron, Evry; Michel Prasloix, St Michel Sur Orge, both of France

[73] Assignee: Compagnie Generale D'Automatisme CGA-HBS, France

[21] Appl. No.: 116,302

[22] Filed: Nov. 4, 1987

[30] Foreign Application Priority Data

Nov. 4, 1986 [FR] France ..... 86 15353

[51] Int. Cl.[4] ..... B41J 3/20

[52] U.S. Cl. ..... 400/120; 346/76 PH; 400/551; 400/596; 400/630; 400/642; 400/649; 400/708

[58] Field of Search ..... 400/120, 649, 596, 551, 400/642, 661.1, 708, 708.1, 639, 637.1, 624, 630; 346/76 PH; 271/245

[56] References Cited

U.S. PATENT DOCUMENTS

| | | | |
|---|---|---|---|
| 4,000,393 | 12/1976 | Cochran et al. | 400/120 |
| 4,234,261 | 11/1980 | Hendrischk et al. | 400/596 |
| 4,422,782 | 12/1988 | Lawter et al. . | |
| 4,439,051 | 3/1984 | Lawter . | |
| 4,448,559 | 5/1984 | Matsuda et al. . | |
| 4,583,873 | 4/1986 | Parks et al. | 400/624 |
| 4,687,362 | 8/1987 | Rünzl | 400/624 |
| 4,725,858 | 2/1988 | Bond | 400/649 |
| 4,744,687 | 5/1988 | Nukaya et al. | 400/624 |

FOREIGN PATENT DOCUMENTS

| | | | |
|---|---|---|---|
| 0089287 | 9/1983 | European Pat. Off. . | |
| 0099957 | 2/1984 | European Pat. Off. . | |
| 0155997 | 10/1985 | European Pat. Off. . | |
| 85979 | 5/1985 | Japan | 400/624 |
| 8369 | 1/1986 | Japan | 400/642 |
| 8604021 | 7/1986 | PCT Int'l Appl. . | |
| 2147251 | 5/1985 | United Kingdom . | |

OTHER PUBLICATIONS

"Auxiliary Two-up Automatic Document Feeder", Smith, *Xerox Disclosure Journal,* vol. 13, No. 1, Jan.-/Feb. 1988, pp. 1-3.

"Automatic Sheet Feeder", *IBM Technical Disclosure Bulletin,* vol. 28, No. 3, Aug. 1985, pp. 1061-1062.

*Primary Examiner*—Edgar S. Burr
*Assistant Examiner*—Moshe I. Cohen
*Attorney, Agent, or Firm*—Sughrue, Mion, Zinn, Macpeak & Seas

[57] ABSTRACT

The platen (11) is mounted between two side plates (9-10) of equipment which is hinged to two risers (5-6) to rotate about an axis $\gamma$ running parallel to the axis of the platen. The platen is provided with a freewheel mechanism including an inner ring (28) which is connected to the platen and an outer ring (29) which is provided with a peg (31) engaged in a slot (8) in a fixed member (7). The slot is situated on the opposite side of the platen axis $\Delta$ relative to the axis of rotation $\gamma$ and in substantially the same plane. Detector means (36-37) for detecting the presence of a document in an insertion channel (17) cause the platen to rotate in the direction in which the freewheel mechanism drives the outer ring, thereby pressing the peg against the slot and rocking the equipment about the axis $\gamma$ thus allowing a document to pass between the print head and the platen until it meets an abutment (14) which is moved into place by the rocking action. When the document is detected as engaging the abutment, the platen is rotated in the opposite, document-driving direction, and return means press the platen against the print head.

2 Claims, 3 Drawing Sheets

THERMAL PRINT HEAD PRINTER INCLUDING A PLATEN

The present invention relates to a printer. More particularly the invention relates to a printer having a thermal print head for printing on pre-cut heat-sensitive documents.

The invention relates particularly to filling in small pre-printed forms which need information adding thereto, or to writing small pre-recorded texts.

The present invention provides a printer comprising: a base; a thermal print head connected to the base; a platen roll for pressing against and driving a document to be printed, the geometrical axis Δ of the platen lying parallel to the active line of the print head, an insertion channel for said document to guide it towards said active line of the print head between the print head and said platen; and drive means for rotating said platen, the printer being characterized: in that said platen is mounted to rotate freely between two side plates of moving equipment which moving equipment is hinged to two lateral risers connected to said base allowing said moving equipment to rotate about an axis γ parallel to the axis of the platen; in that the printer includes a freewheel mechanism including an outer ring and an inner ring, the inner ring being mounted coaxially with the platen at one of its ends and being constrained to rotate therewith, and the outer ring of said freewheel mechanism having a peg projecting sideways therefrom and engaging in a slot provided in a thrust member which is fixed to said base, said slot being situated on the opposite side of said platen axis Δ relative to said hinge axis γ; and in that the printer further includes detection means for detecting the presence of a document in said insertion channel, with the detection of a document causing said platen to rotate in the reverse direction to the direction for driving the document past the print head, said direction corresponding to the direction in which the freewheel mechanism drives the outer ring, thereby thrusting said peg against a wall of said slot and consequently moving the platen by reaction away from the print head by rotating said moving equipment about said hinge axis y against the force of return means, said rotation of the moving equipment bringing an abutment connected to the moving equipment onto the path of said document a little way downstream from the active line of said print head, and detection means for detecting when said document is in abutment against said abutment serving to cause said platen to be rotated in the document-driving direction and the print head to be powered.

According to another characteristic of the invention, downstream from the print head, the document is guided by guide means returning it via a curved path towards an outlet adjacent to the inlet of said insertion channel and lying parallel to said inlet.

There follows a description of a particular embodiment of the invention made with reference to the accompanying drawings, in which:

FIG. 3 is a view in the direction of arrow III in FIG. 2, and FIG. 4 is a view in the direction of arrows IV in FIGS. 2 and 3.

Figure 1:
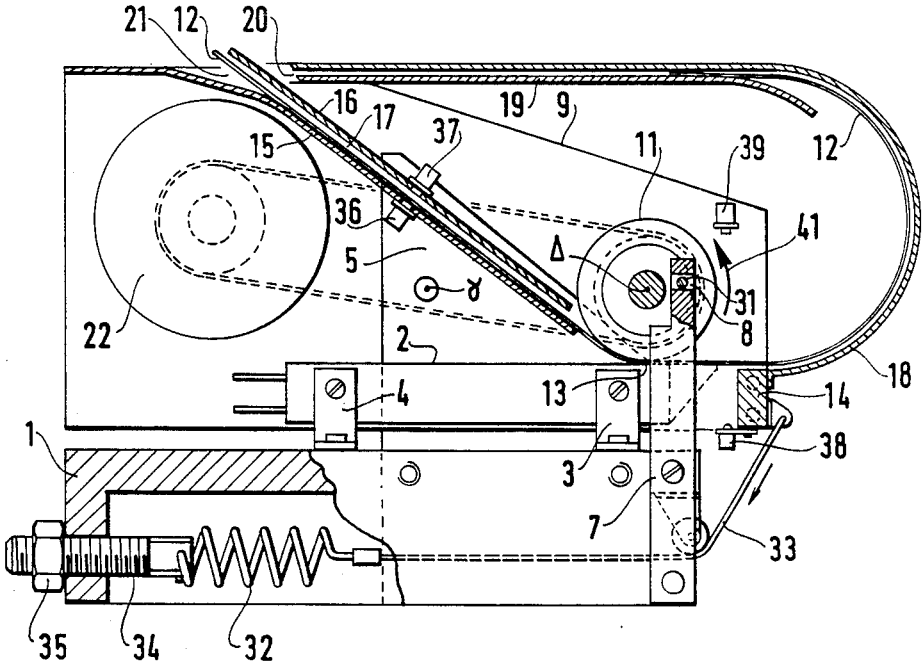
FIG. 1 is an elevation in partial section on line I—I of FIG. 2 showing a printer in accordance with the invention.
Figure 2:
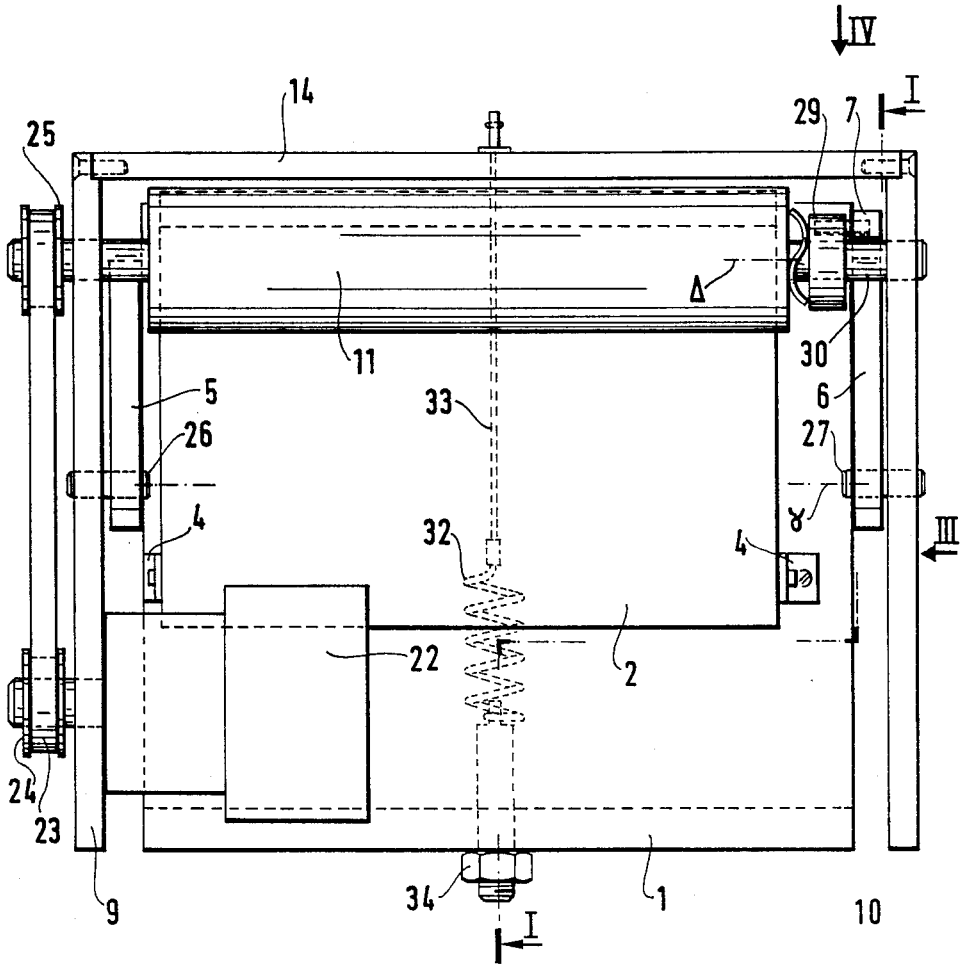
FIG. 2 is a plan view of the printer from which certain members have been removed in order to show the moving equipment's hinge system relative to the base.
Figure 4:
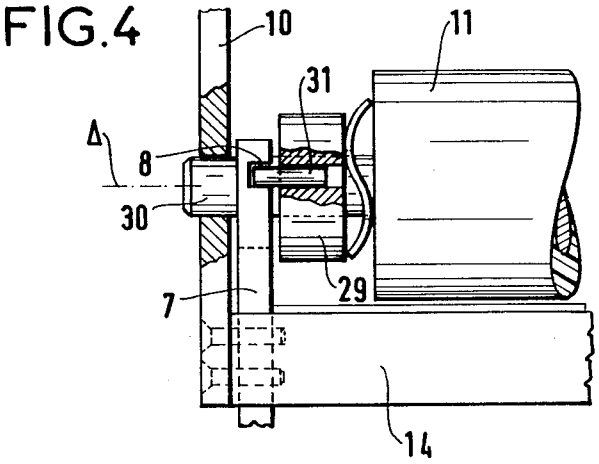
FIGS. 3 and 4 are two detail views of the printer showing its freewheel mechanism and its function for moving the platen and print head apart.

In FIGS. 1 to 4, there can be seen a base 1, and a thermal print head 2 which is connected to the base by fixing means such as 3 and 4. Two lateral risers 5 and 6 are fixed to the base 1. A thrust member 7 is also fixed to the base at the same end as the lateral riser 6 and adjacent to the riser. A slot 8 is provided in the top end of this thrust member whose function is described below.

The above assembly forms the fixed portion of the printer and a moving equipment is hinged thereto, comprising two side plates 9 and 10 between which there is a platen roll 11 which is mounted to rotate freely and which serves to drive a document 12 to be printed and to press it against the thermal print head 2. The geometrical axis Δ of the platen 11 is parallel to the top plane of the print head 2 and to its active line 13 which is situated immediately below the bottom generator line of the platen 11. The side plates 9 and 10 of the moving equipment are spaced apart by a beam 14 which also acts as an abutment for the document 12 to be printed at a particular moment in the operation of the printer as explained below.

This moving equipment additionally has bodywork connected thereto comprising walls 15 and 16 which delimit a channel 17 for inserting and guiding the document 12 to be printed towards the active line 13 of the print head so that it passes between said line and the platen 11, and also walls 18 and 19 constituting guide means for the document downstream from the print head 2 and returning the document via a curved path to an outlet 20 adjacent to the inlet 21 to the insertion channel 17, and disposed parallel to said inlet 21. A drive motor 22 for rotating the platen 11 is also connected to the moving equipment. A belt 23 passing over pulleys 24 and 25 serves to transmit rotation from the motor 22 to the platen 11.

This moving equipment is hinged to the fixed portion of the printer, with the risers 5 and 6 of the fixed portion being hinged to the side plates 9 and 10 of the moving equipment about an axis γ parallel to the axis Δ of the platen 11, by means of stub axles 26 and 27.

At its end adjacent to the thrust member 7, the platen 11 has a freewheel mechanism comprising an inner ring 28 and an outer ring 29.

The inner ring 28 is fixed to rotate coaxially with the platen 11 about its stub axle 30 which is received in the side plate 10. A peg 31 projects from the side of the outer ring 29 and is engaged in the slot 8 of the thrust member 7.

Figure 3:
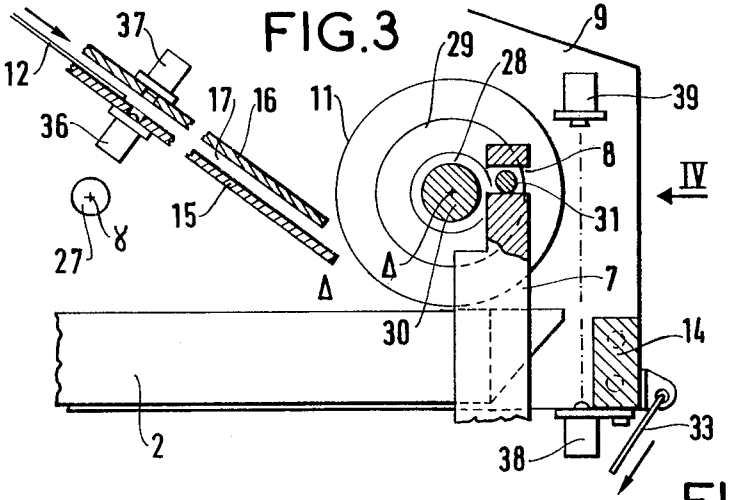
Figure 5:
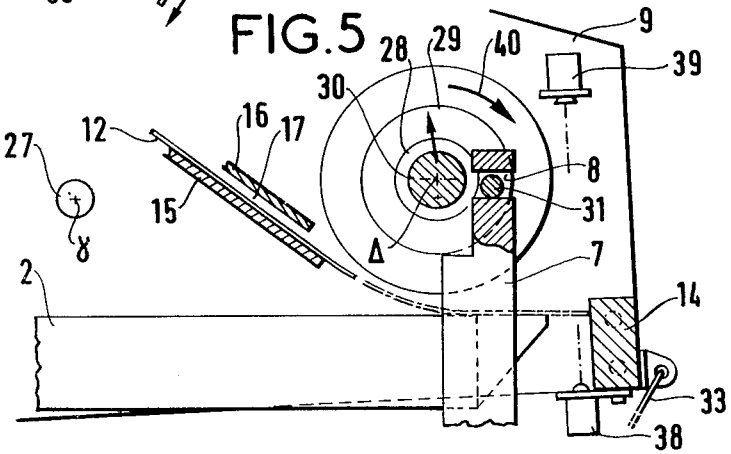
FIG. 5 is a view similar to FIG. 3 but showing the print head moved away from the platen.

As can be seen in FIGS. 1, 3, and 5, the slot 8 and thus also the peg 31 are situated on the opposite side of the platen's axis of rotation Δ from the hinged axis γand in substantially the same plane as these two axes Δ and γ. Depending on the position of the platen, i.e. pressed against the print head (see FIG. 3), or else at a distance therefrom (see FIG. 5), the slot 8 and the peg 31 are situated either slightly above or else slightly below the alignment of Δ and γ.

A traction return spring 32 is connected at one end to the abutment beam 14 of the moving equipment by means of a flexible thread 32, and at its other end to the base 1 by means of a screw 34 and a nut 35 enabling the traction force to be adjusted.

Finally, a first opto-electrical detector 36-37 serves to detect the presence of a document 12 in the insertion channel 17, and a second opto-electrical detector 38-39 detects when the document reaches the abutment 14 (see FIG. 5).

The thermal print head 2, the motor 22, and the opto-electrical detectors 36-37 and 38-39 are connected to a power supply and to control electronics in a manner well known to the person skilled in the art.

The printer operates as follows:

At rest, the assembly is in the position shown in FIGS. 1 and 3, with the document 12 not yet being inserted and the platen 11 being stationary.

The moving equipment is urged by the return spring 32 so that the platen 11 is pressed against the print head 2, thereby preventing a document to be printed from being inserted between the print head and the platen.

The user of the printer initializes its program by acting on the power supply and control electronics assembly.

The document 12 is then inserted into the insertion channel 17. When the document passes through the first optoelectrical detector 36-37, the motor 22 is switched on so that the platen 11 rotates in the direction indicated by arrow 40 in FIG. 5, i.e. in the reverse direction to the document driving direction. The platen is rotated through a few degrees only. since the direction of rotation corresponding to that indicated by arrow 40 is the direction in which the outer ring 29 of the freewheel mechanism is driven in rotation, and since the outer ring 29 carries a peg 31, the peg comes into abutment against the wall of the slot 8 in the fixed thrust member 7, thereby causing the entire moving equipment to rotate by reaction about the hinge axis $\gamma$ and against the return spring 32, thus moving the platen 11 away from the print head 2 and bringing the abutment beam 14 into the document path a little way downstream from the print head.

This position is shown in FIG. 5. In this position the rear of the moving equipment comes into abutment against the base 1.

The user pushes the document 12 up to the abutment 14. The second opto-electrical detector 38-39 then detects that the document is against the abutment and causes an audible signal to be generated for one second. When the signal stops, the motor 22 is rotated in the opposite direction corresponding at to platen rotation in the direction of arrow 41 in FIG. 1, and also corresponding to the freewheel direction for the outer ring 29 which is therefore not driven. As a result, the peg 31 no longer presses against the end of the slot 8 and the return spring 32 returns the platen so that it presses against the document 12 and the print head 2. The platen is then rotated normally and the print head 2 is simultaneously powered to print on the document in accordance with the program that has been prepared. The document is driven by the platen since the abutment 14 has been retracted.

FIG. 5 shows the document 12 in dot-dashed lines in its position in abutment against the abutment 14, and FIG. 1 shows the assembly in the middle of printing: the abutment 14 is retracted and the platen 11 is pressed against the document 12 and against the head 2. Downstream from the head 2, the document is guided by the wall 18.

At the end of the print cycle, an audible signal is emitted and the user may extract the document which projects through the outlet 20. The light barrier of the optoelectrical sensor 38-39 is no longer interrupted and the printer is ready to receive a new document for a new print cycle.

We claim:

1. A printer comprising: a base (1); a thermal print head (2) for printing along an active line connected to the base; a platen roll (11) for pressing against and driving a document (12) to be printed, said platen roll having a geometrical axis $\Delta$ lying parallel to the active line (13) of the print head, an insertion channel (17) for said document to guide it towards said active line of the print head between the print head and said platen; drive means (22 to 25) for rotating said platen, and moving equipment having two side plates, the printer being characterized: in that said platen is mounted to rotate freely between said two side plates (9-10) of said moving equipment, which moving equipment is hinged to two lateral risers (5-6) connected to said base allowing said moving equipment to rotate about an axis $\gamma$ parallel to the axis of the platen; the printer including a freewheel mechanism including an outer ring (29) and an inner ring (28), the inner ring (28) being mounted coaxially with the platen at one of its ends and being constrained to rotate therewith, and a thrust member having a slot and being fixed to said base, the outer ring (29) of said freewheel mechanism having a peg (31) projecting sideways therefrom and engaging in the slot (8) provided in the thrust member (7), said slot being situated on the opposite side of said platen axis $\Delta$ relative to said hinge axis $\gamma$; the printer further including detection means (36-37) for detecting the presence of a document in said insertion channel, with the detection of a document causing said platen to rotate in a reverse direction to the direction for driving the document past the print head, said reverse direction corresponding to the direction in which the freewheel mechanism drives the outer ring (29), thereby thrusting said peg against a wall of said slot and consequently moving the platen by reaction away from the print head by rotating said moving equipment about said hinge axis $\gamma$ against the force of return means, an abutment (14) connected to the moving equipment, said rotation of the moving equipment bringing said abutment onto the path of said document a little way downstream from the active line of said print head (2), and detection means (38-39) for detecting when said document is in abutment against said abutment serving to cause said platen to be rotated in the document-driving direction of the print head to be powered.

2. A printer according to claim 1, characterized in that said insertion channel has an inlet and an outlet, and downstream from the print head the document is guided by guide means (18-19) returning it via a curved path towards the outlet (20) adjacent to the inlet (21) of said insertion channel and lying parallel to said inlet.

* * * * *